US005203144A

United States Patent [19]

Gambetti

[11] Patent Number: 5,203,144

[45] Date of Patent: Apr. 20, 1993

[54] MACHINES FOR PACKAGING ARTICLES WITH HEAT-SHRINKING MATERIAL

[75] Inventor: Mario Gambetti, Crevalcore, Italy

[73] Assignee: Baumer S.r.l., Castelfranco Emilia, Italy

[21] Appl. No.: 835,134

[22] Filed: Feb. 12, 1992

[30] Foreign Application Priority Data

Apr. 3, 1991 [IT] Italy ..... B091 A/000104

[51] Int. Cl.[5] ..... B65B 11/06; B65B 49/00; B65B 41/02

[52] U.S. Cl. ..... 53/465; 53/210; 53/389.1

[58] Field of Search ..... 53/210, 389.5, 557, 53/589, 588, 590, 209, 389.1, 463, 465, 442

[56] References Cited

U.S. PATENT DOCUMENTS

| | | | |
|---|---|---|---|
| 2,424,406 | 7/1947 | Marshall et al. . | |
| 2,953,880 | 9/1960 | Sramek et al. . | |
| 3,276,184 | 10/1966 | Holt | 53/210 X |
| 3,540,187 | 11/1970 | Monaghan | 53/210 X |
| 3,585,783 | 6/1971 | Holt | 53/210 X |
| 3,791,100 | 2/1974 | Monaghan . | |
| 3,869,844 | 3/1975 | Edouard . | |
| 3,927,507 | 12/1975 | Reid . | |
| 3,995,791 | 12/1976 | Schoppee . | |
| 4,499,709 | 2/1985 | Miyano et al. | 53/210 X |
| 4,574,565 | 3/1986 | Gambetti . | |
| 4,693,053 | 9/1987 | Ballestrazzi et al. | 53/389.5 |
| 4,706,444 | 11/1987 | Gambetti . | |
| 4,875,329 | 10/1989 | Miselli . | |

FOREIGN PATENT DOCUMENTS

| | | |
|---|---|---|
| 958377 | 5/1964 | United Kingdom . |
| 1037261 | 7/1966 | United Kingdom . |
| 1296306 | 11/1972 | United Kingdom . |
| 1355571 | 6/1974 | United Kingdom . |
| 1382842 | 2/1975 | United Kingdom . |

*Primary Examiner*—John Sipos
*Assistant Examiner*—Linda B. Johnson
*Attorney, Agent, or Firm*—Herbert Dubno; Yuri Kateshov

[57] ABSTRACT

An apparatus for the packaging of articles with pieces of sheet of heat-shrinking material includes three coplanar feed, wrapping and product delivery conveyors, a conveyor for delivering sheets of the wrapping material and wrapping device for wrapping the products to operate in a continuous operation, a device is provided for operating the machine continuously and the device for supplying the sheets with at least two aligned conveyor members of which the downstream member is equipped with a device which cyclically differentiates the drive transmission speed.

4 Claims, 3 Drawing Sheets

MACHINES FOR PACKAGING ARTICLES WITH HEAT-SHRINKING MATERIAL

FIELD OF THE INVENTION

This invention relates to a machine for packaging articles with heat-shrinking material.

BACKGROUND OF THE INVENTION

The machines currently in use for packaging single articles of substantially rectangular shape, or more frequently for wrapping groups of individual articles comprising, as a rule, containers for consumables in general and in particular food products and the like of a unit having rectangular shape, subsequently referred to as articles, with heat-shrinking material, and includes automatic machines with an intermediate or continuous movement which are designed on the basis of multiple modes for wrapping the heat-shrinking material around the individual articles to be wrapped.

In accordance with this known wrapping machines it is usual to wrap the article to be wrapped in the direction in which it is moving using the heat-shrinking sheet material in such a way that the material extends beyond the two opposite sides of the article and then the whole assembly is passed through a tunnel stove to cause the material to adhere by heat-shrinking to the wrapped sides and to the two opposite sides of the article before folding the corresponding material onto the latter sides.

Some known machines for wrapping such individual articles which are caused to advance in a continuous succession in an intermittently equally spaced arrangement or in a continuous manner use two sheets of the heat-shrinking material which are rhythmically passed above and below two successive articles respectively in a sealing station where they are transversely joined together by welding and then cut so as to close off or seal progressively the enclosure or wrapping for a preceding article and respectively join the sheets for wrapping of the next article Articles so wrapped are then caused to advance through a tunnel stove to cause the material to adhere by heat-shrinking to the wrapped sides and to the opposite sides of the corresponding article after the corresponding surplus material has been folded up against the latter two sides (see for example U.S. Pat. Nos. 3,869,844 and 3,927,507).

Other known machines for packaging the articles which are caused to advance in an equidistant arrangement with continuous movement provide for the use of a single sheet of the heat-shrinking material.

One type of these latter known machines provides the sheet to be fed parallel to the direction of movement of the longitudinally equally spaced articles and folds it as it advances in a tubular shape with its corresponding longitudinal edges overlapped around the advanced articles with the overlapped edges to be joined by heat welding.

The articles so wrapped or enclosed in the tubular shape of sheet are then caused to pass their continuous movement first through a first station or first tunnel stove for a first heat-shrinking of the material around the articles, and then, upon leaving the first station, through a second station to cut the sheet in tubular form between two successive articles, so that there is surplus material all around the posterior and anterior sides between two successive articles, and finally through a third station or second tunnel stove to complete the action by causing the material to adhere by heat-shrinking to the wrapped sides and to the anterior and posterior sides of the same article after the corresponding material has been folded up against these latter sides (see GB no. 1,382,842).

Still another known machines use only one sheet for wrapping articles which are caused to advance in an equally spaced arrangement with continuous movement provide the sheet to be fed from the top in such a way as to extend it over the articles in such a way so as to overlap the two opposing lateral sides, and to carry it, drawing from the corresponding spool downwards in a loop folded form between successive articles in order to thrust it in the direction of movement of the articles beneath the previous articles where the looped portion is cut thereby producing two ends or edges of wrapping material which are posterior for the preceding article and anterior for the immediately following article.

In the course of the continuous movement of the articles the edges corresponding to each article are caused to overlap each other on the lower or bottom side of the article and then, while continuing their movements, the articles so wrapped are successively placed within a tunnel stove to cause the wrapping material to adhere by heat-shrinking in the usual way to the wrapped sides and the two opposite sides of the article after the corresponding material has been folded against the latter two sides (see GB patent No. 1,355,571).

From the known art in the field of packaging it is already known how sheets or pieces of packaging material cut from a sheet delivered from a feed spool across the path of articles to be packed can be provided in a continuous movement in such a way as to become folded in a horizontal U-shape against the anterior side and the two upper and lower parallel sides of the article adjacent thereto with the terminal parts of the arms of the U-shape extending beyond the posterior side and then fold the terminal parts onto the latter side where they are joined or sealed together when partly overlapped.

The means provided to implement this form of packaging normally comprise at least two pairs of opposing belt means performing a closed movement to carry the longitudinal edges of the said sheets to convey them across the direction of movement of the objects being packed (see GB patent 1,037,261 and U.S. Pat. No. 2,424,406), or by only two of the means in closed movement located respectively at the longitudinal edges so as to hold them by suction (see GB patent 958,377 and U.S. Pat. No. 2,871,257).

The machines which use the latter method of U-shaped bending of the packaging material with final folding and joining of the edges of the sheets by sealing on the posterior side of the articles being wrapped require complicated devices both for this last folding and for sealing. As a result, these machines for the wrapping of articles with heat-shrinking material which already have a tunnel stove to cause the material to adhere to the articles by heat-shrinking of the heat-shrinking material which is therefore also heat-weldable, it is preferred, if not directly expedient require the method having steps of first folding the heat-shrinking material around the anterior, upper and posterior sides of the article with an overturned U-fold and then refolding the terminal parts of the U-shaped onto the bottom side of the article with partial overlap.

Unseccessful attempts have been made to eliminate the complicated bending and sealing arrangements for the edges on the posterior side of products using the heat source of the tunnel stove to effect joining and sealing of the overlapping parts of the edges of the U-shape wrapping material on the lower side of the articles. The action of the stove causing the heat-shrinking packaging material to adhere to the product by heat-shrinking and therefore providing greater flexibility, i.e. a greater productive output per unit time and a more economic cost for wrapping with these machines using the heat-shrinking material, in practice has not made it possible to pursue an improved machines because of the complexity of the mechanisms used to achieve folding and overlapping of the aforesaid terminal parts of the edges of the U-shaped material turned over the lower side of the articles (see for example aforesaid GB no. 1,355,571).

This drawback has been eliminated. Applicant's Italian patent No. 1,169,175 of the 23 Feb. 1983 proposing and subsequently constructing a machine for the wrapping of articles fed in an equally spaced succession by means of a continuously moving conveyor with sheets cut progressively from a sheet of heat-shrinking material extending beyond the two lateral sides of the articles and then subsequently moved by suction holding means along the corresponding longitudinal edges across the direction of advance of the individual successive articles so as to be folded onto the anterior, superior and inferior faces of a corresponding article in a horizontal U-shape with a terminal portion of the said U-shaped material extending beyond the corresponding posterior side in such a way as to be folded against the posterior side and overlapped at the folded terminal portion over the inferior face. This machine is provided with the conveyor constructed from two lengths of adjacent transporter sheet and the holding means supported opposite the zone consisting of the two adjacent lengths of sheet material and in which zone the contiguous zones of the two sheets pass round at least one corresponding pair of return rollers supported by an alternately moving carriage parallel to the direction of transport. The holding means are movable alternately vertically and parallel with respect to the movement of the carriage. Further, the machine was improved in other Italian Patent No. 1,186,646 has issued in the name of applicant of 11 Nov. 1985 and provided an improvement by implementing different means for feeding sheets cut from the sheet of heat-shrinking wrapping material across the line of movement of the articles to be wrapped and thereby improving the efficiency provided by the two adjacent lengths of transporter sheet.

Substantially, these different means for feeding the sheets of wrapping material comprise at least one pair of wrapping bars supported horizontally in continuous motion along a track surrounding the article which is to be wrapped in a continuous movement so that while one of the said bars wraps the wrapping material around a following article in the shape of a horizontal U on the anterior side and the two upper and lower sides of the following article, the other folds the terminal portion of the wrapping material onto the posterior side of the preceding article, so that the tail end of the terminal zone of material is folded back onto the underside above the initial zone of the improved contiguous lengths of transporter sheet thus achieving the maximum technological development of these machines now commercially available for continuous packaging using heat-shrinking sheet material in respect of both the quality of product obtained and greater productivity per unit time.

OBJECTS OF THE INVENTION

Known machines are provided with a conveyor system coordinated with the movement with at least one wrapping bar by successively positioning one end of a piece of wrapping material at one end of a conveyor activated intermittently by the wrapping system, for example as described and claimed in U.S. Pat. No. 3,791,100, in which an article which is being wrapped is placed on the positioned end of the wrapping material and then is moved forward until it is completely supported on the conveyor, after which the conveyor is stopped. While the article is on the stopped conveyor the wrapping bar is moved along a track which passes round the conveyor and carries the other end of the wrapping material about the article, positioning it in such a way that when the article moves on another conveyor of the system the latter folds the end positioned beneath the article and the edge is then welded and the wrapping material is heat shrunk to form an adhering or enclosing sleeve wrapping. In this U.S. Pat. No. 3,791,100, means are also provided for controlling the feed of wrapping material from a continuous spool mounted below the conveyor system, located between the track of the movement of the wrapping bar to separate the piece of material of desired length and to hold the anterior end of the separated material in position at the end of the intermittent conveyor until the article is placed upon it. More specifically such a machine essentially comprises a wrapping conveyor having a feed end, a delivery end and an upper surface between the two ends to support and convey successive articles which need to be wrapped; means to receive articles adjacent to the delivery end of the said wrapping conveyor but spaced therefrom; an endless transporter carrying at least one wrapping bar along a track which surrounds the said wrapping conveyor to wrap the wrapping material about an article on the said wrapping conveyor; means to feed the wrapping material to supply a first piece of wrapping material to the wrapping conveyor and place the anterior end thereof above the upper surface of the wrapping conveyor adjacent to its feed end, the means for the feed of wrapping material including means to maintain the first piece of wrapping material suspended during the travel of the wrapping bar, and means including the wrapping bar to carry the suspended piece and advance it to the feed end of the wrapping conveyor; means for feeding articles to pass at least a first article which has to be wrapped to the feed end of the said wrapping conveyor and onto the anterior end of the wrapping material; first sensitive means activated when the first article is positioned on the conveyor in a predetermined position, with at least part of the said article placed on the anterior end of the wrapping material in order to stop the wrapping conveyor; operative means when the said conveyor is stopped to move the endless transporter means and the wrapping bar in movement along the track to pass the posterior end of the first piece of wrapping material over the said first article and then in front of it, adjacent to the delivery end of the wrapping conveyor, while the anterior end of the wrapping material remains retained beneath the article; the means for feeding the wrapping material are synchronised with the wrapping bar to provide a second piece of wrapping material and advance the anterior end thereof to the inlet end of the conveyor while the wrapping bar is passing the posterior end of the first piece over and then in front of the first article; and operating means when the wrapping material is thus passed around the first article to start up the wrapping conveyor to pass the article onto the means for receiving articles to cause the posterior end of the wrapping material to pass over the anterior end thereof beneath the article.

With a machine constructed in this way the article which is to be wrapped is stopped at the time when it is wrapped with the wrapping material by the wrapping bar which is also stopped during the stages in which the article advances before and after the wrapping stages with the result that such a machine is universally regarded as a machine having a low production rate per unit time.

In fact improvements have already been made in practice to cause intermittent movement machines to operate with a continuous movement by taking steps to control the movement of the wrapping material from the corresponding spool by breaking and by providing one or more loops as a buffer for this wrapping material to alter the rate of feed in a cyclical manner in respect of both the so-called spool changing stage, see for example patents U.S. Pat. No. 2,953,880, GB 1,296,306 and U.S. Pat. No. 3,995,791, and as regards feed of the individual pieces of the said wrapping material, and also in order to use operations relating to the formation of the said individual products, see for example U.S. Pat. No. 4,875,329, both mechanically and electromechanically.

These objects of this invention are obtained by an improvement to cause to function the wrapping machine in continuous movement which traditionally operates by means of an intermittent or stepwise movement to wrap articles with pieces of sheet of heat-shrinking material comprising essentially a wrapping conveyor having one feed end, a delivery end and an upper surface between the two ends to support and convey successive articles which have to be wrapped, means to supply the wrapping material to provide a succession of pieces of wrapping material to the wrapping conveyor placing the anterior ends of those sheets above the upper surface of the wrapping conveyor at its feed end; means to deliver and receive the articles placed respectively upstream and downstream of a transport path and adjacent each other but at a distance from the corresponding feed and delivery ends respectively of the wrapping conveyor; endless transporter means carrying at least one wrapping bar along a track which surrounds the wrapping conveyor to wrap the pieces of sheets of heat-shrinking material about a corresponding article on the wrapping conveyor; and activating means capable of activating the wrapping conveyor, the said feed means for the wrapping material, the means for delivering and receiving articles and the endless transporting means for the wrapping bar are in synchronous operation, which improvement is characterised in that the activating means are continuously movable and the means for feeding the wrapping material to supply a succession of pieces of wrapping material to the wrapping conveyor keeping the anterior ends thereof above the upper surface of the wrapping conveyor at its feed end comprise at least two transport members located in series one after the other in which the downstream one in the direction of the movement of transport is subjected to a device which cyclically differentiates the transmission speed of the drive which is in turn subject to the continuously moving activating means.

BRIEF DESCRIPTION OF THE DRAWING

The above and other objects, features and advantages of the improved machine according to this invention will be more clearly apparent from the following description which is given purely by way of example with reference to the appended drawings in which.

SPECIFIC DESCRIPTION

Figure 1:
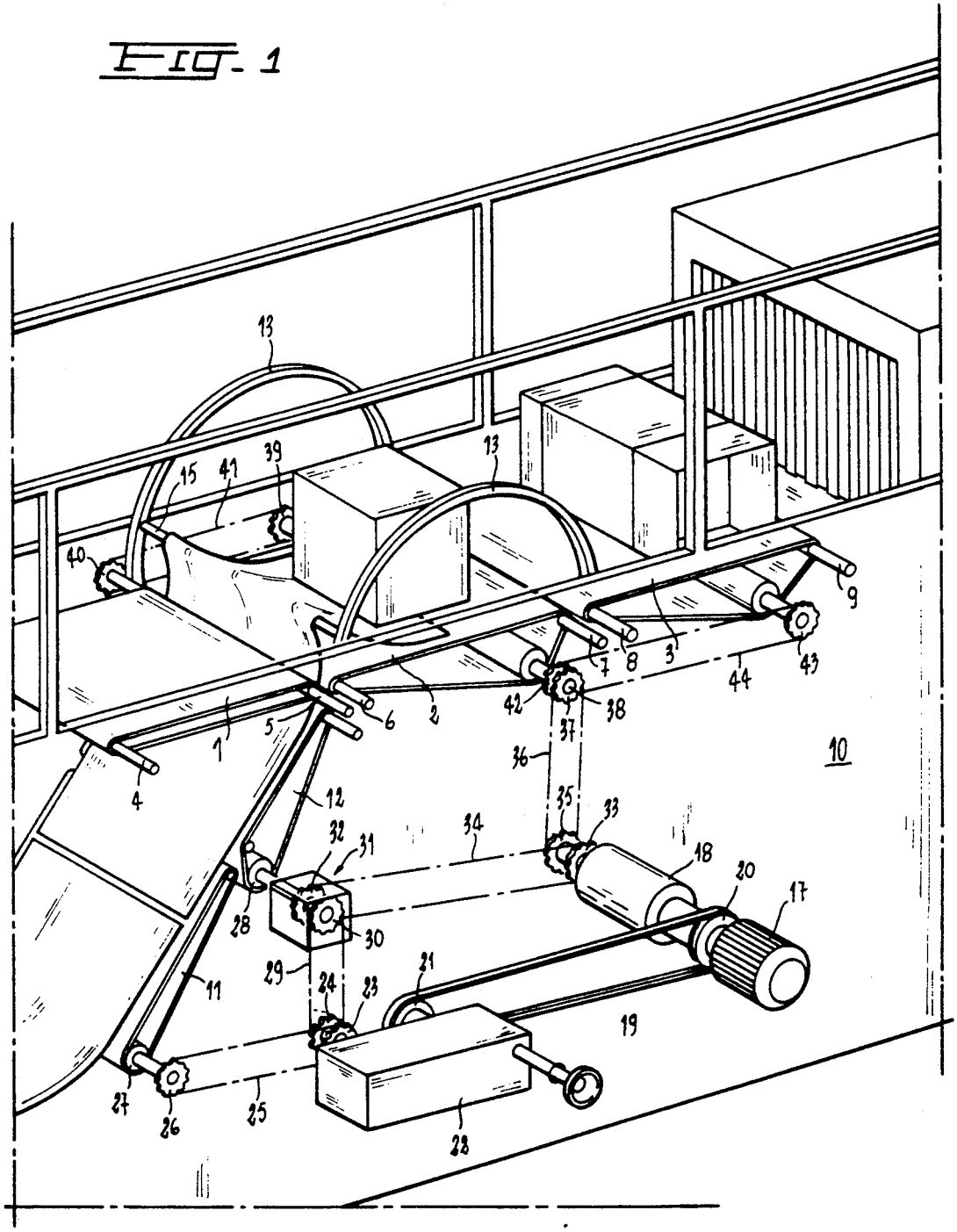
FIG. 1 is a foreshortened frontal-longitudinal perspective view of the machine according to the invention.

The improved machine according to this invention as shown in FIG. 1 is of the type comprising essentially three endless conveyors 1, 2, 3 with a carrying surface moving on corresponding shafts 4, 5; 6, 7; 8, 9 located in the same horizontal plane and aligned and respectively spaced on a supporting base which is shown diagrammatically and indicated as a whole by 10.

In accordance with this invention base 10 also supports two coplanar transporters 12 which are located and inclined beneath the three conveyors 1, 2, 3 in such a way that the most downstream one indicated by 12 ends close to the space separating the two conveyors 1 and 2 in the series of three conveyors 1, 2, 3, and a structure 13 which can rotate around conveyor 2 about a horizontal axis 14 shown in FIGS. 2–7 and bearing two horizontal wrapping rods 15, 16 whose function will be better understood here below.

The drive system for the two series of conveyors 1, 2, 3 and 11, 12 includes a drive motor 17 which directly drives the speed reduction gear 18 and a speed varying device 22 indirectly by means of a motion transmitting belt or chain 19 which passes around two belt or chainwheels 20.

On the output shaft (which cannot be seen) of speed varying device 22 are keyed two belt or chainwheels 23, 24 for driving conveyor 11 by means of belt or chain 25 which also passes round the corresponding chainwheel 26 wedged to the drive roller 27 and conveyor 12 respectively by means of a corresponding drive shaft 28 by means of a belt or chain 29 driving an inlet member 30 of a cyclical differentiating device for the drive transmission speed system 31 whose output member 32 keyed to said shaft 28 is activated by speed reducer 18 by means of chainwheel 33 and corresponding chain 34 which via chainwheel 35 and chain 36 which also turns around chainwheel 37 also drives shafts 38 driving conveyors 2, 1 and 3 by means of corresponding chainwheels 39, 30 and chain 41; 42, 43 and chain 44 (see FIG. 1).

In practice, such a drive mechanism for operating the aforesaid machine which traditionally operates in an intermittent manner with continuous movement by operating the three conveyors 1, 2, 3 feeding the articles which are to be wrapped in a continuous movement in a cyclical ratio from 0.5 to 1 of the speed of conveyor 11 and respectively 0.5 for 120° and 1 for 240° of conveyor 12 feeding the pieces of wrapping material S (see in particular FIGS. 2–7) has achieved a considerable increase in the production speed per unit time of these machines which are considered to be slow in the specific field of low cost packaging.

Figure 2:
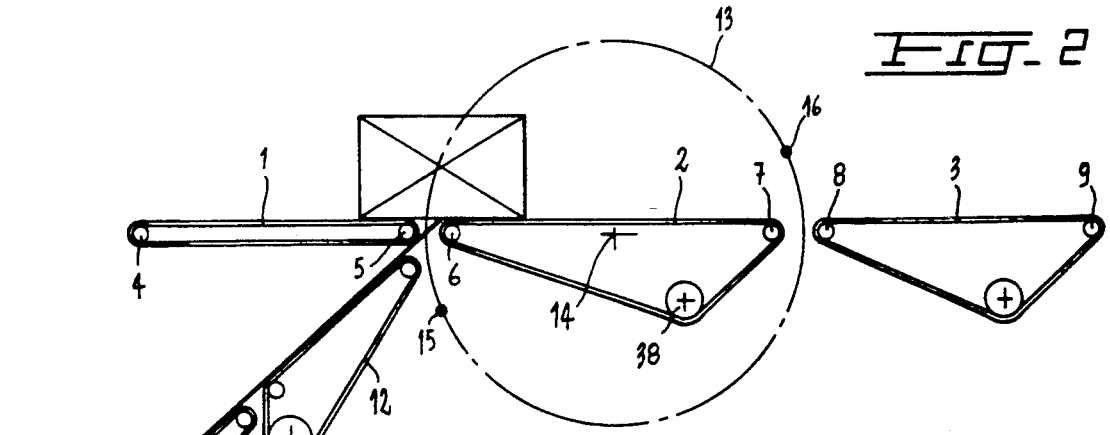
FIGS. 2–7 are stages in the operation of the machine in diagrammatic form.

Refering to FIG. 2, a piece of wrapping material S is fed along transporters 11 and 12 having cooplanar upper stretches thereof. The transporter 11 is driven at a constant speed chosen according to a overall length of the wrapping material segment and regulated by device 22.

When a front of the article emerge between on conveyors 1 and 2 and the article is partly advanced along conveyor 2, the device 31 causes shifting of the drive from wheel 30 to wheel 32 thus differentially reducing the speed of transporter 12 to that one of the linear speed of conveyor 2 in order to interpose a leading edge of the material segment between the conveyor and the article to wrapped.

Figure 3:
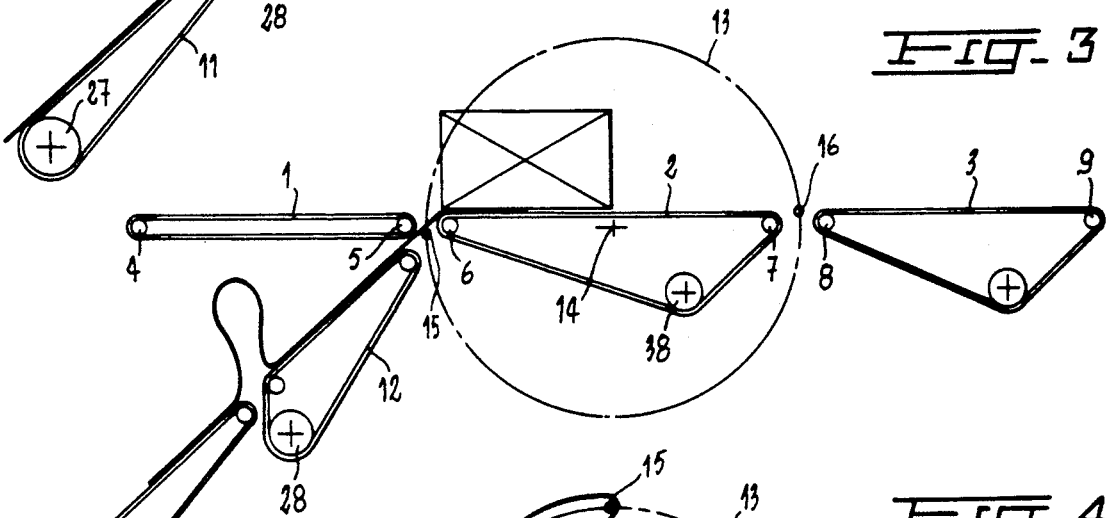
Figure 4:
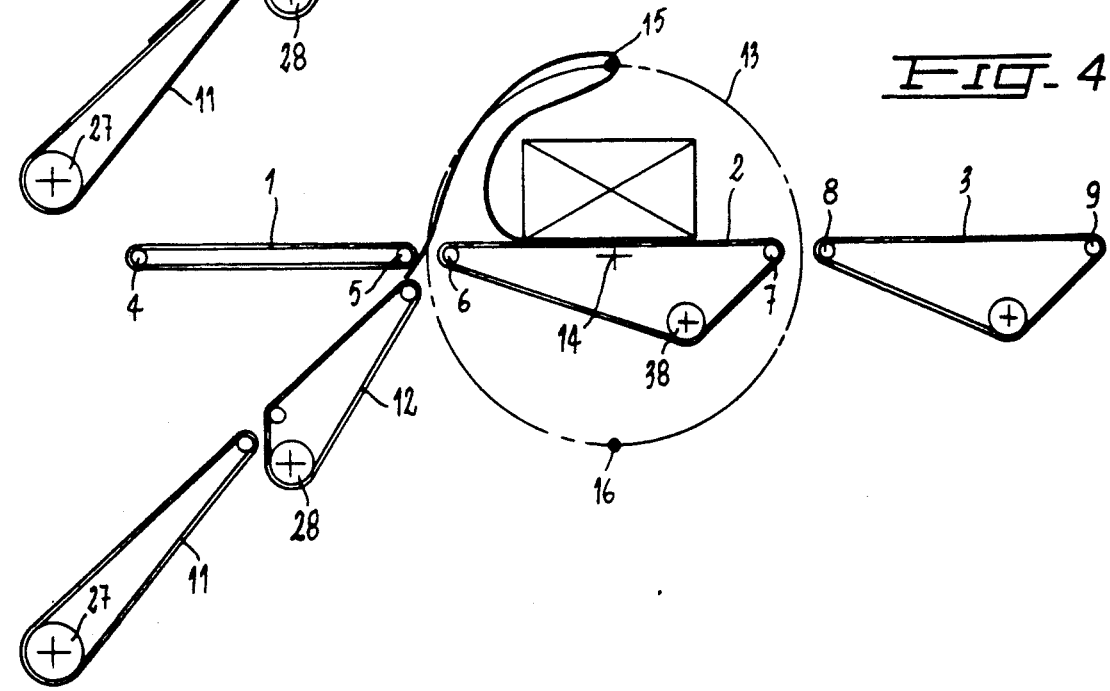
Figure 5:
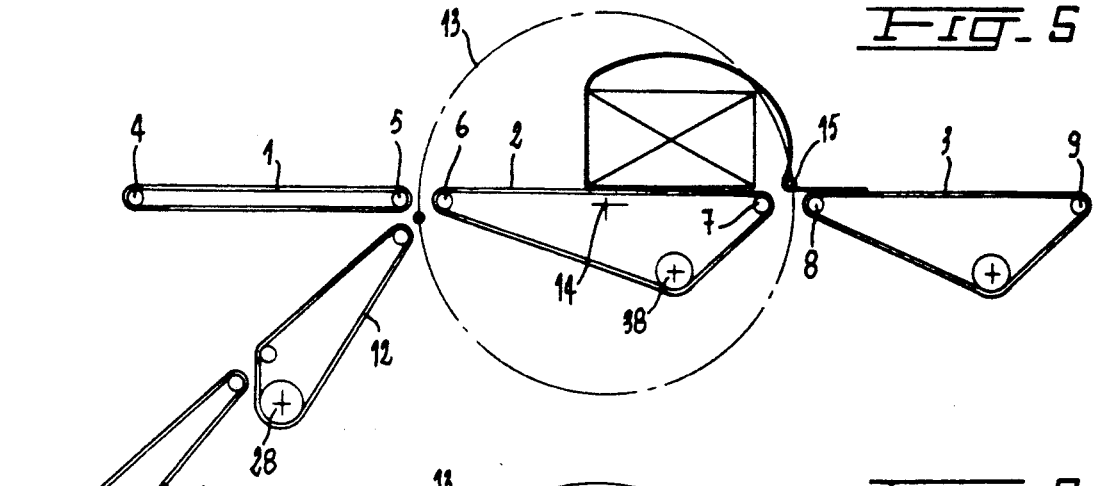

Further, as shown in FIG. 3 the article is advanced along with the material segment with the uniform speeds of transporter 12 and conveyor 2. At the same time the speed of advancement of transporter 11 is higher than that one of the transporter 12. The speed difference causes forming of a loop S' between the transporters. One of the bars, for example bar 15, contacts the material segment upon advancing of the whole article along conveyor 2.

As soon as the contact is made the bar 15 and the transporter 12 again driven at the higher speed upon reverse operation in the device 31 move at approximately the same speed which is higher than the linear speed of the conveyors 1, 2 and 3. Thus, the bar with a trailing portion of the material segment passes between the conveyors 2 and 3 before the leading end of the article is able to reach a passage between these conveyors. This operation is clearly illustrated in FIGS. 4 and 5.

Figure 6:
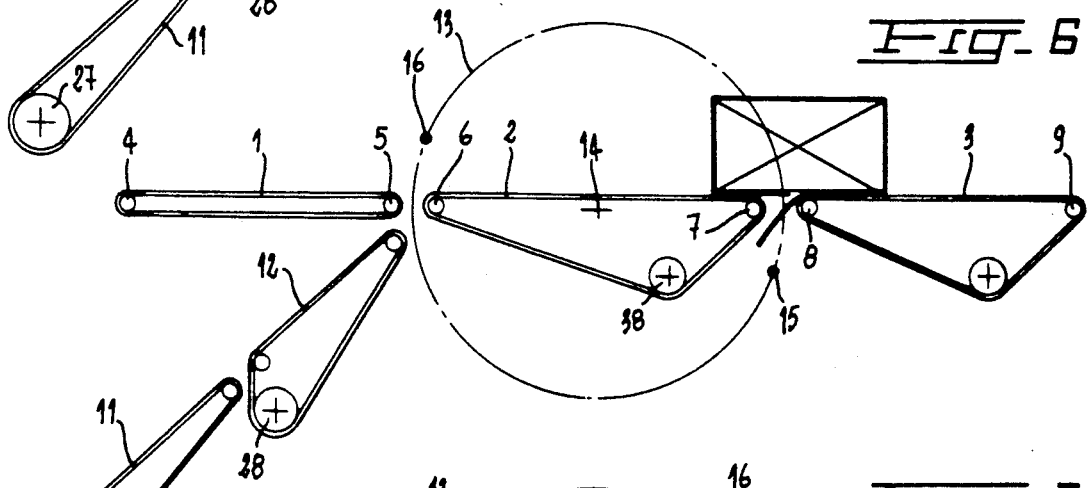
Figure 7:
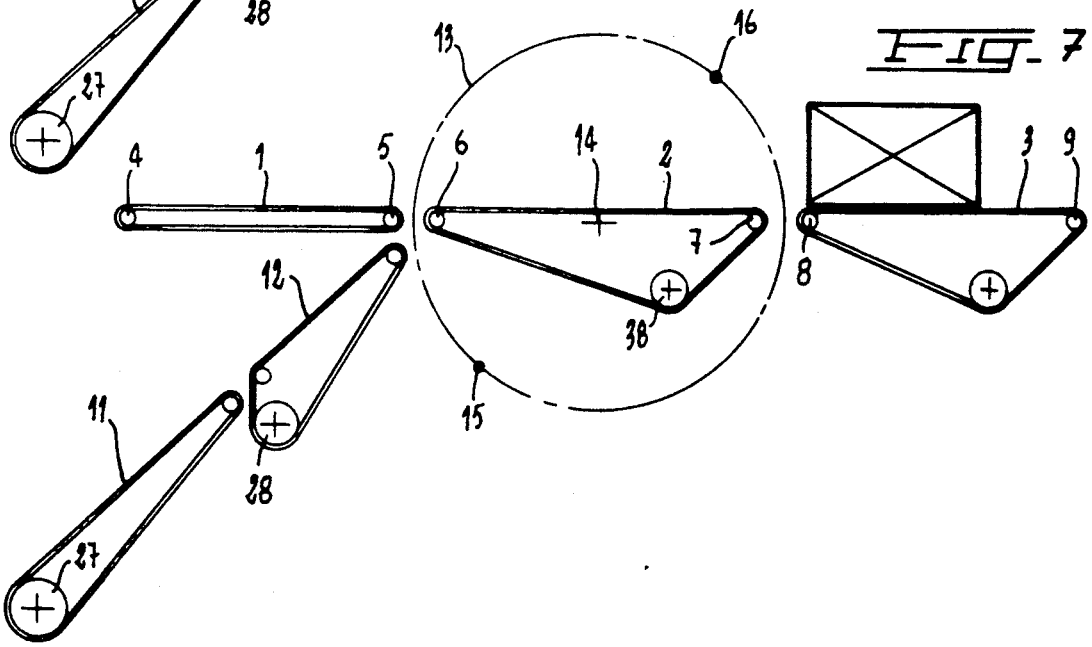

Finally, FIGS. 6 and 7 show the article gradually transferring to the receiving conveyor 3. Upon this movement the trailing portion of the material segment underlies the front of the article for further known welding and heat sealing.

The description of the improved machine in question made with reference to the figures in the appended drawings is obviously provided only by way of example and it is therefore obvious that all those modifications and variants suggested by practice and by its implementation and utilisation or use and in any event within the scope of the following claims may be made to it.

I claim:

1. A wrapping machine comprising:

a frame;

conveyor means on said frame including at least one endless conveyor for continuously advancing a plurality of successive articles to be wrapped along a transport path at a transport speed;

transporter means on said frame for supplying a plurality of segments of wrapping material in succession to said conveyor, said transporter means including:

first and second endless transporters, one of said transporters being driven at a constant speed and being upstream of the other one of said transporters;

wrapping means including at least one bar displaceable along a closed path around said endless conveyor at wrapping speed for wrapping each of said articles with the respective segment upon advancing said article along said transport path, said wrapping speed being higher than said transport speed; and control means for cyclically varying an advancing speed of said other one of said endless transporters from said transport speed upon interposing a leading portion of said segment between said article and said conveyor to said wrapping speed while said article advances along said path, so that said bar carrying a trailing portion of said segment traverses said transport path while said article advances along said transport path.

2. The machine defined in claim 1 wherein said first transporter is spaced angularly downwardly from said conveyor, said second transporter being mounted between said first transporter and conveyor and driven at said transport and wrapping speeds.

3. The machine defined in claim 1 wherein said control means includes a differential device including a first input transmission train for driving said second transporter at said transport speed and a second train for driving said second transporter at said wrapping speed.

4. A method of operating a wrapping machine comprising the steps of:

(a) continuously advancing a plurality of spaced apart articles along a delivering endless conveyor at a transport speed;

(b) advancing each of said articles at said transport speed toward a wrapping endless conveyor spaced from said delivering conveyor;

(c) simultaneously with step (b) supplying respective segments of wrapping paper along a first transporter movable at a constant speed and a second transporter downstream of said first transporter movable at said transport speed for interposing a leading end of the segment between a bottom of the article and the wrapping conveyor, said constant speed of the first transporter being higher than said transport speed;

(d) thereafter displacing a guiding bar at a wrapper speed higher than said transport speed along a closed path for carrying a trailing end of the segment of paper over the article while advancing the article with the leading end of the segment along said wrapping transporter;

(e) simultaneously with step (d) increasing a speed of said second transporter from said transport speed to said wrapper speed, thereby bringing said trailing end of the segment beneath the bottom of the article;

(f) thereafter joining said trailing and leading ends together;

(g) simultaneously with step (e) reducing said wrapping speed of the second conveyor to said transport speed; and (h) repeating steps (b) through (f).

* * * * *